United States Patent [19]

Mueller et al.

[11] Patent Number: 4,545,505

[45] Date of Patent: Oct. 8, 1985

[54] ELECTRONIC CONTROL CIRCUITS FOR ELECTRICALLY CONDUCTIVE LIQUIDS/SOLIDS

[75] Inventors: Richard J. Mueller, Atlanta; Edmund E. Chow, Lilburn, both of Ga.

[73] Assignee: Reed Industries, Inc., Stone Mountain, Ga.

[21] Appl. No.: 397,995

[22] Filed: Jul. 14, 1982

[51] Int. Cl.[4] ..... B67D 5/62

[52] U.S. Cl. ..... 222/65; 222/146.6

[58] Field of Search ..... 222/65, 53, 63, 146 C, 222/54; 307/118, 76; 62/398; 340/620

[56] References Cited

U.S. PATENT DOCUMENTS

| | | | |
|---|---|---|---|
| 3,196,625 | 7/1965 | Nicolaus | 222/146 C |
| 3,892,335 | 7/1975 | Schroeder | 222/146 C |
| 4,008,832 | 2/1977 | Rodth | 222/146 C |
| 4,263,587 | 4/1981 | John | 340/620 |

*Primary Examiner*—Stanley H. Tollberg

[57] ABSTRACT

An electronic control circuit for carbonated beverage dispensing machines employs the low voltage AC supply for the solenoid dispensing valves as a source of clipped, balanced ac which is applied to one or more water-imersed sensors. One sensor senses ice mass size and the other senses carbonated water supply level. The balanced ac prevents electroplating by the sensors. Peak detector circuits associated with the sensors produce dc control signals whose levels increase and decrease respectively as the control shut-off point is reached. These dc control signals are applied to Schmitt circuits, the output of one of which is used to control the carbonated water supply pump and the other of which inversely controls the refrigerant compressor. In addition, the balanced ac signal is used to clock a counter which is held at full count. Reset for this counter is effected in response to solenoid valve energization and the counter output is OR'ed with the refrigerant compressor signal to control the coolant water agitator motor.

14 Claims, 16 Drawing Figures

ELECTRONIC CONTROL CIRCUITS FOR ELECTRICALLY CONDUCTIVE LIQUIDS/SOLIDS

BACKGROUND OF THE INVENTION

Carbonated beverage dispensing machines normally include a carbonated water supply in the form of a water reservoir to which $CO_2$ under pressure is supplied and the gaseous head of $CO_2$ in this reservoir is used to expel the carbonated water when a dispensing nozzle is opened. Consequently, the carbonated water supply in the reservoir is gradually depleted and must be replenished periodically by a pump having its inlet connected to fresh water source. Various means have been used to assure an adequate supply of carbonated water.

Also, such machines pass the carbonated water through a coil located in a coolant water reservoir, which reservoir also contains a refrigerant evaporator coil which is used to build up an ice mass or "bank" thereon to assure the proper temperature of coolant water. Various means, usually in the form of timing devices, have been used to control the size of the ice mass or bank.

BRIEF SUMMARY OF THE INVENTION

This invention is concerned with improved control for the carbonated water level and/or for the size of the ice bank. To this end, probes are employed respectively to provide resistance value changes responsive to carbonated water level and responsive to ice mass or ice bank size. These probes form part of electronic control circuitry for controlling the carbonated fresh water supply pump motor and/or the refrigerant compressor motor.

In one aspect, this invention concerns an electronic control circuit which can adapt to either of the above probes.

An another aspect, this invention concerns a multiple electronic control circuit which incorporates controls adapting for both of the above probes and which also includes additional controls which operate an agitator for the cooling water whenever the refrigerant compressor is operated to control the size of the ice bank or when a dispensing nozzle valve solenoid is actuated. In the latter case, the agitator is also continued in operation for a fixed time delay after the valve solenoid has been deenerzied.

The probes or sensors connect electrically to ground either through the coolant water or through the carbonated water supply. Resistance changes to these grounds are sensed. The sensing signal is a clipped, balanced 8.2 VAC, 60 Hz signal derived from the 24 VAC supply which drives the dispensing valve solenoids. The balanced ac prevents electroplating by the sensors.

The sensor resistance changes are detected by a peak detector circuitry to pump at least one capacitor having a fixed drain and the voltage variation on this capacitor is used as the variable input to a Schmitt trigger circuit. The upper threshold of the Schmitt trigger is reached when the sensed resistance value reaches a predetermined upper limit whereas the lower threshold is reached when the resistance value reaches a predetermined lower limit. In one embodiment the circuitry, includes means for selectively controlling a switch either from the output of the Schmitt trigger circuit or from the inverted output of the Schmitt trigger circuit. This embodiment may be employed to retrofit an existing machine, in which case either the ice bank size probe is used to trigger the Schmitt circuit after which inversion is necessary, or the carbonated water level probe is used with no inversion of the Schmitt trigger output. These functions are necessary because the resistance value of the ice bank size probe increases as the ice bank size increases whereas the resistance value of the carbonated water level probe decreases as the water level rises.

Both functions are incorporated in a single circuit which may be used with a new machine specifically adapted for full control. In addition, this circuitry includes a pulse generator which responds to solenoid valve operation to reset a counter. The counter normally receives the balanced ac as a clock input and will "count" and "hold" at a predetermined count of the 60 Hz balanced ac. In this state, an agitator motor control switch is held off until the "reset" from the pulse generator occurs. When the solenoid valve is deenergized so that "reset" discontinues, the counter will count up for a fixed time period before the agitator motor is again deenergized.

An OR gate is employed between the refrigerant compressor motor control and the agitator motor control so that the latter is energized either while the compressor is operated or (with the fixed time delay) in response to solenoid valve operation.

BRIEF DESCRIPTION OF THE DRAWING FIGURES

FIG. 11 is a simplified block diagram showing certain principles of the electronic control;

DETAILED DESCRIPTION OF THE INVENTION

Figure 1:
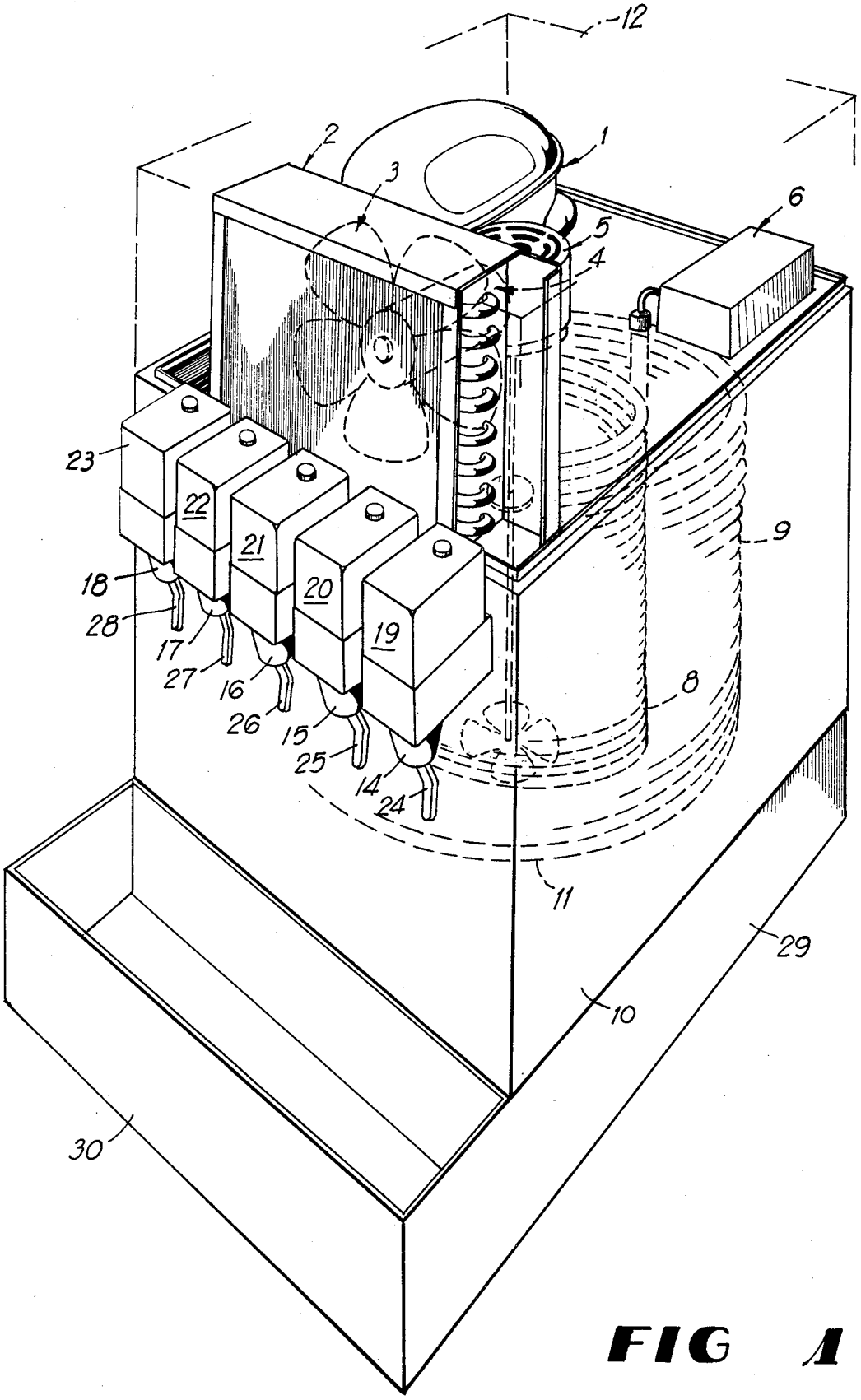
FIG. 1 is a perspective view, partly in phantom, illustrating a carbonated beverage dispensing machine.
Figure 2:
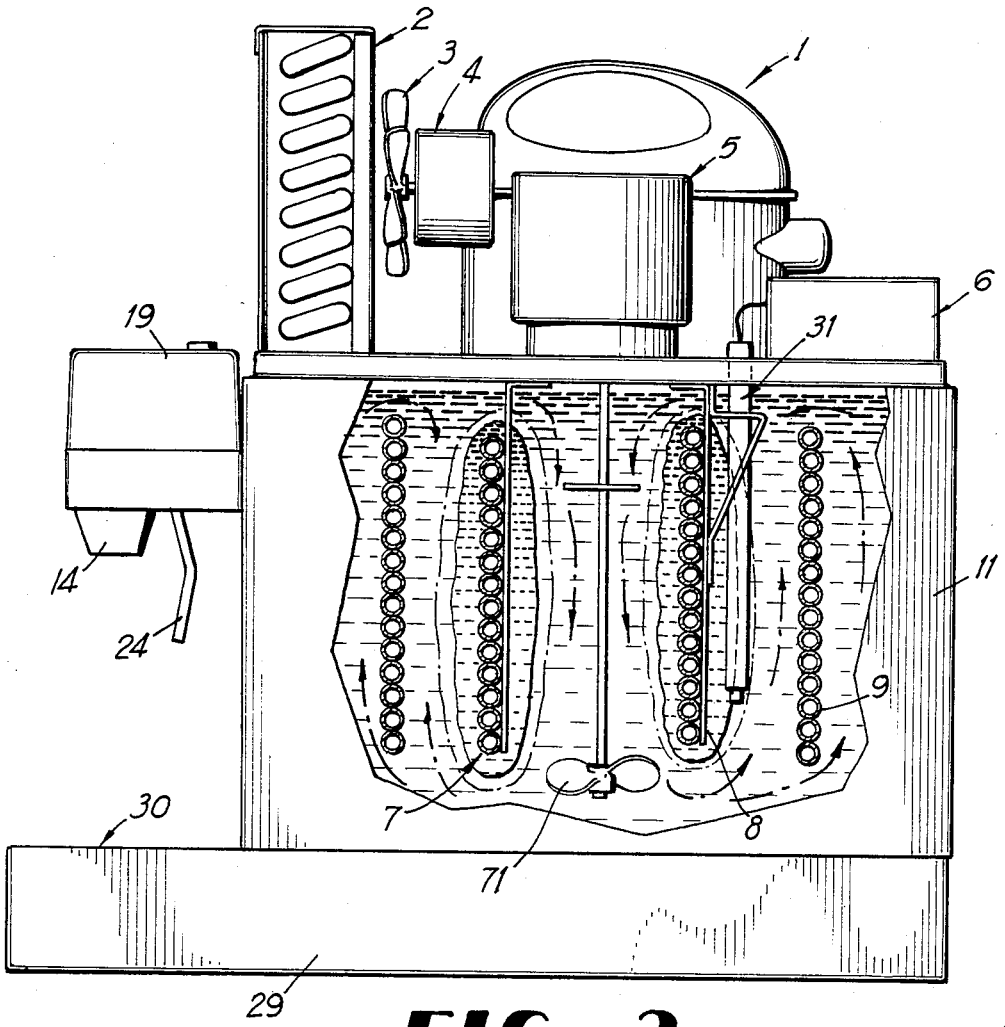
FIG. 2 is a side elevation of the machine, partly broken away and in section to illustrate the coolant water reservoir and integers therein.

FIGS. 1 and 2 illustrate a mixed drink dispenser of generally conventional construction. The machine includes the body 10 provided with suitable insulation and housing a reservoir 11 for coolant water. Mounted atop the body but beneath the cover 12 is the compressor assembly 1, the condenser 2 with the cooling fan 3 and its motor 4, the agitator drive motor 5 and the electronic control module 6. The compressor 1, when its motor is energized, circulates refrigerant through the refrigerating coil 7 located within the coolant reservoir and through the condenser 2 in conventional, closed cycle fashion thereby to create an ice bank 8 which is of sufficient size as to maintain the coolant water at the desired temperature. The coil 7 is of generally cylindrical form, vertically aligned as shown. Surrounding the coil 7 and its ice bank 8 is the carbonated beverage cooling coil 9, also of cylindrical form as shown. This coil 9 is connected to a line 13 from a source of carbonated water (FIG. 5) and at its outlet end to a suitable manifold or distributing line (not shown) having branches leading to individual nozzles of the bank of dispensing nozzles 14–18 (see FIG. 1). As is conventional, each dispensing nozzle is provided with a valve for dispensing the mixed drink, each valve being controlled by its respective solenoid 19–23 which is energized through the medium of a switch actuated by the respective lever 24–28 operatively associated with the nozzles. The base 29 of the machine is provided with the usual catch basin or pan 30 below the nozzles and which may be provided with a reticulated screen or mesh for supporting the container which receives the mixed drink, all as is conventional.

In machines of this type, it is desirable that the ice bank 8 be controlled as to its size so that the proper temperature of cooled water is maintained but, at the same time, it is desirable that the ice bank be built up only to a certain size, otherwise the temperature in the coil 9 may become too low and, in any event, excessive ice bank size represents inefficient use of energy.

Figure 3:
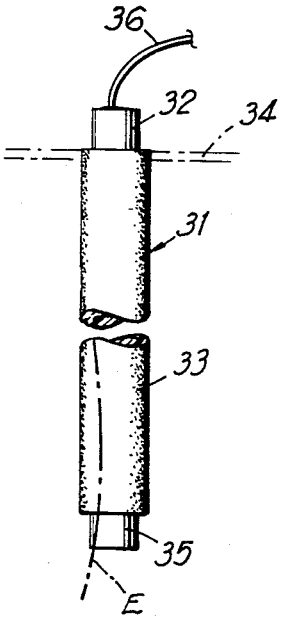
FIGS. 3 and 4 illustrate the ice bank size sensor.
Figure 4:
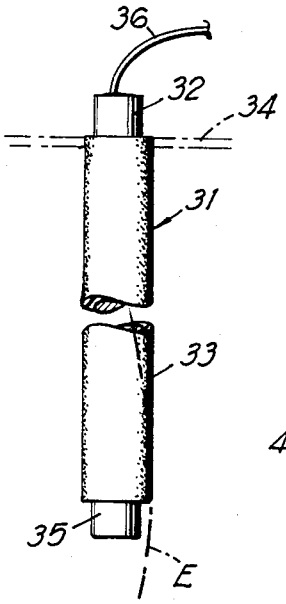

In one aspect, this invention concerns the capability of controlling the compressor 1 directly in accord with the size of the ice bank 8. For this purpose, the sensor 31 may be provided, the details of which are illustrated in FIGS. 3 and 4. As shown, the sensor comprises a conductive rod 32 surrounded for the major part of its length by the sleeve 33 of electrically insulating and water impervious material. The sleeve 33 is mounted to project through the top or cover 34 of the coolant water reservoir 11 so that only the tip 35 of the conductive rod 32 which is not covered by the sheath 33 may be exposed to direct contact with water in the reservoir 11. Thus, when located relative to the coil 7 as shown in FIG. 2, the tip 35 will contact the coolant water (FIG. 3) until the envelope E of the ice bank 8 expands to enclose the tip (FIG. 4). Because the resistivity of ice is much greater than that of water, any current supplied to the conductor 36 will "see" a much greater resistance value with respect to a conductor grounded to the coolant water for the case of FIG. 4 compared with the case of FIG. 3. As the envelope E builds in FIG. 4, the resistance value will increase whereas as the envelope shrinks to a size which will just or substantially just expose a surface of the tip 35, the resistance value will tend to zero. The circuitry of the control 6 is operative to control the size of the ice bank very accurately by appropriate control of the motor driving the compressor 1 as will be detailed hereinafter.

Figure 5:
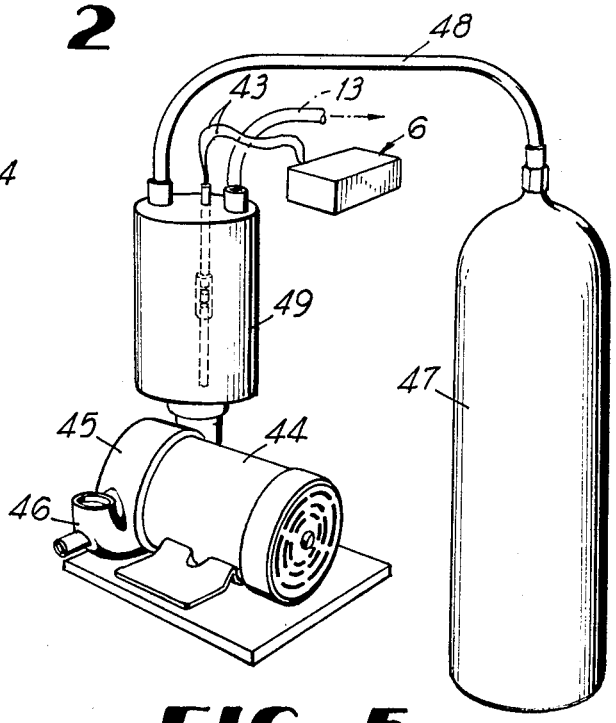
FIG. 5 is a perspective view of the carbonated water supply system.
Figure 6:
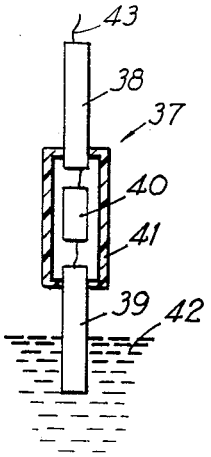
FIGS. 6, 7 and 8 illustrate the carbonated water level sensor.
Figure 7:
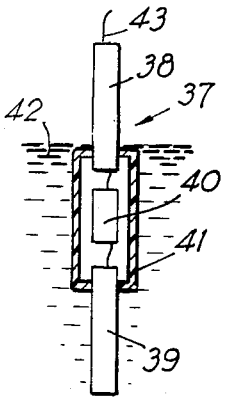
Figure 8:
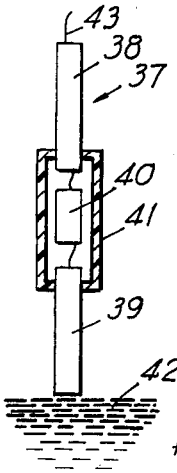

Another control which may be desired either alternative to or in consonance with the ice bank size is the accurate control of the carbonated water supply shown in FIG. 5. In this case, the sensor 37 shown in FIGS. 6–8 is employed. This sensor takes the form of two electrically conductive rods 38 and 39 electrically connected by the resistor 40 with the housing or sheath 41 of electrically non-conductive and water impermeable material fully insulating the resistor 40 from ambient carbonated water 42. Thus, when the carbonated water is at a low level as indicated in FIG. 6, an electrical current signal applied to the conductor 43 will "see" the full value of the resistor 40 plus resistance of water and will continue to "see" such value until the water level just contacts the upper rod 38, as in FIG. 7, then it will "see" a low resistance. As the carbonated water supply drops to fall below the lower end of the rod 39, as in FIG. 8, the resistance value will be almost infinite. The circuit 6 may also accommodate for water level control sensed by the sensor 37, thereby to energize the motor 44 (FIG. 5) which drives the supply pump 45. The pump 45 is provided with a water inlet 46 to the normal or minimized water supply, a $CO_2$ bottle 47 is provided with a conduit leading to the tank 49 containing the carbonated water supply 42, as is conventional.

Certain principles of the invention will be evident from the block diagram of FIG. 11. As shown, the sensor S constitutes a resistance element whose absolute value is variable, either continuously or as a step function, in response to the parameter being sensed. The control function, as will appear, may be made responsive to either a change from a high value of sensor resistance to a low value thereof or vice versa. The circuit illustrated is provided with means (J) for selecting the control function.

The sensor S is connected to one input of the Schmitt trigger circuit ST serially through the current limiting circuit CL and the positive peak detector circuit PD. The output of the Schmitt trigger is applied both to the inverter circuit IN and to the junction C. The inverted output of the inverter is connected to the junction point B and the jumper J. The jumper J is connected either between junctions A and C, as shown, or between junctions A and B, dependent upon the control response required as noted above.

The control signal at the junction A is connected to the switch SW and the condition of this switch either makes or breaks the circuit from the 115 VAC lines L1 and L2 to the motor M.

The 115 VAC supply is also connected to the step down transformer TR to produce a 24 VAC output which is applied to the clipping circuit CP and the clipped output is connected to the sensor S, as shown at the junction D.

If the value of resistance of the sensor S is sufficiently large due to the sensed condition, the voltage at the junction D correspondingly will be high so that the current transferred by the peak detector PD to the capacitor C during positive half cycles of the 60 Hz supply will also increase. The resistor R1 provides a constant current drain for the capacitor C and the values of C and R are so chosen that at the desired operating point, the voltage across the capacitor C reaches the upper threshold or trigger level of the Schmitt trigger circuit ST. The output of the Schmitt trigger at this time closes the switch SW to energize the motor M. When the sensed parameter later causes the resistance value of the sensor S to reach a low value, the voltage below the lower threshold or trigger level of the Schmitt trigger ST and the switch SW is opened to deenergize the motor M.

As thus far described, it should be seen that the desired control action for the sensor illustrated in FIGS. 6–8 is attained when the jumper J is in the connecting position shown in FIG. 11. The motor M in this case is the motor driving the pump 44 of FIG. 5.

When the jumper J connects the junctions A and B in FIG. 11, it should be seen that the desired control action for the sensor illustrated in FIGS. 3 and 4 is attained, in which case the controlled motor M is the motor for the compressor illustrated in FIG. 2.

FIG. 11 has been expanded somewhat from purely block diagram form insofar as the Schmitt trigger and inverter components are concerned, in order to illustrate an important economical consideration in providing a control circuit which may be used to employ either one of the two sensors noted. As shown, the Schmitt trigger ST and inverter IN are formed basically from the two comparator sections of a conventional dual comparator type of integrated circuit, for example an LM393. For the Schmitt trigger, positive feedback is provided by the resistor R2, connected between the output and the non-inverting input. The threshold levels are controlled by the two resistors R3 and R4 whose juncture is connected to the non-inverting input with the resistor R3 being connected to a suitable d.c. source V ref. The inverter section is simply formed by connecting the Schmitt trigger output to the inverting input of the other comparator stage of the LM393, its non-inverting input being connected to the d.c. source by means of the voltage dividing chain R5, R6.

Figure 9:
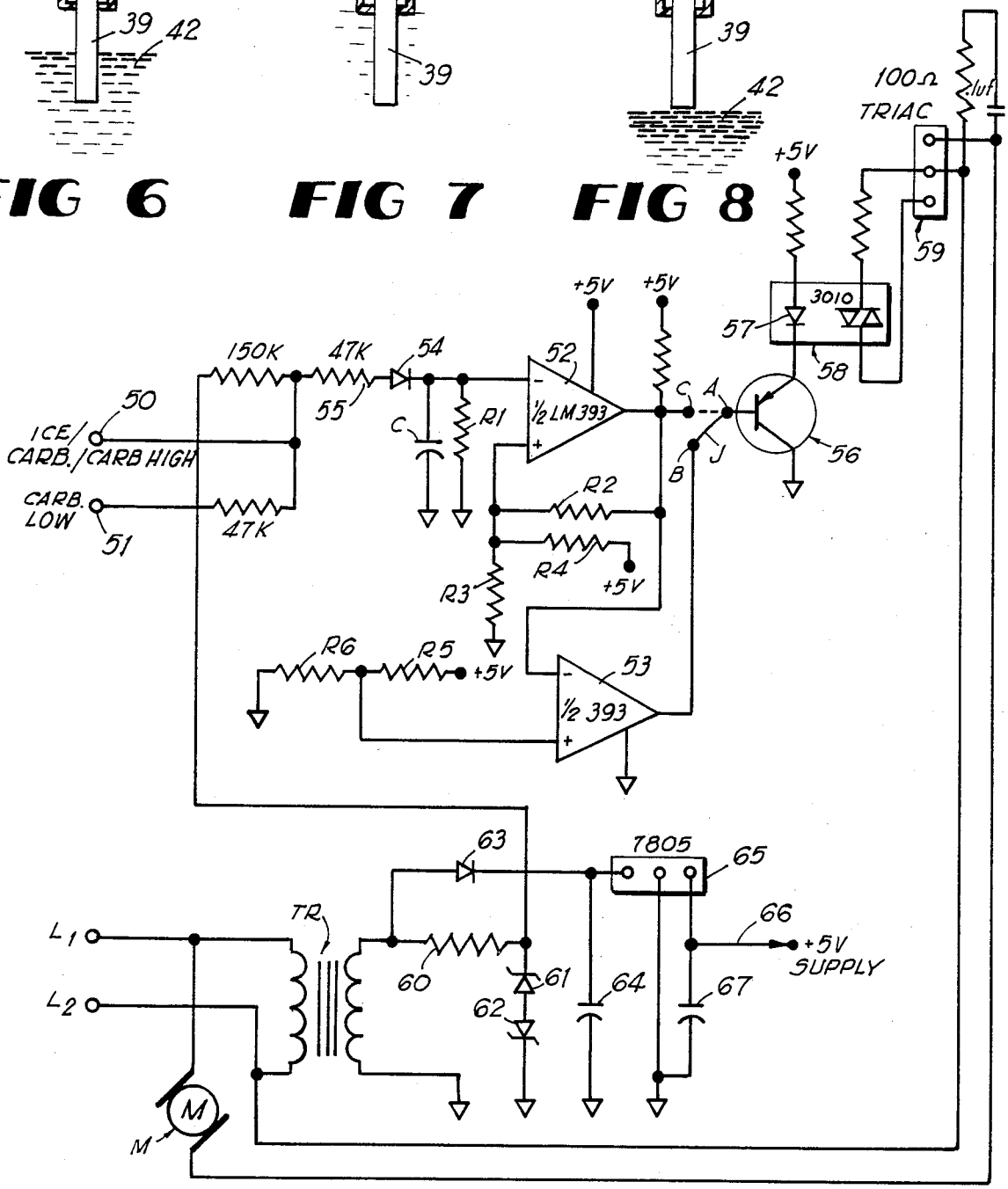
FIG. 9 illustrates the circuitry of an embodiment of the invention.

The complete details of an operative embodiment are illustrated in FIG. 9.

FIG. 9 makes provision for use either of the sensor 31 or the sensor 37. The circuit is provided with input terminals 50 and 51 for two probe carbonator systems. The two comparator sections 52 and 53 with the external circuit components shown comprise the Schmitt trigger St and inverter IN described with repsect to FIG. 11. The peak detector may simply comprise the diode 54 and the current limiter the resistor 55. Junction A is connected to the base electrode of the pnp device 56 which, when switched "on" energizes the LED of the optical coupler 58 (type MOC 3010) which serves to isolate the low voltage control section from the line voltage triac 59. When energized, the coupler 58 turns the triac 59 "on", thus completing the circuit from the supply lines L1, L2 to the motor M. The elements 56, 58 and 59 constitute the switch SW of FIG. 11.

The output of the transformer TR is applied serially through the resistor 60 and the pair of oppositely poled Zener diodes 61 and 62 to ground. These elements constitute the clipper CP of FIG. 11 and act to clip excessive dc voltage while maintaining balanced ac to prevent electroplating by the sensor. The fixed maximum dc voltage is required for precision comparison as well as to eliminate false triggering due to line transients, etc.

The transformer output is also applied through the diode rectifier 63 to the filter capacitor 64 to provide the input to the voltage regulator 65 (type 7805). The output of the regulator at 66 is the regulated +5 V supply noted and the capacitor 67 provides filtering and prevents high frequency oscillation due to the high gain of the regulator.

The control circuit as thus far described is extremely useful in retrofitting an existing machine and allow either ice bank size control or carbonated water level control as aforesaid. Obviously, both of these features could be incorporated in a single circuit and such is the case for the expanded circuit of FIG. 10.

Figure 10:
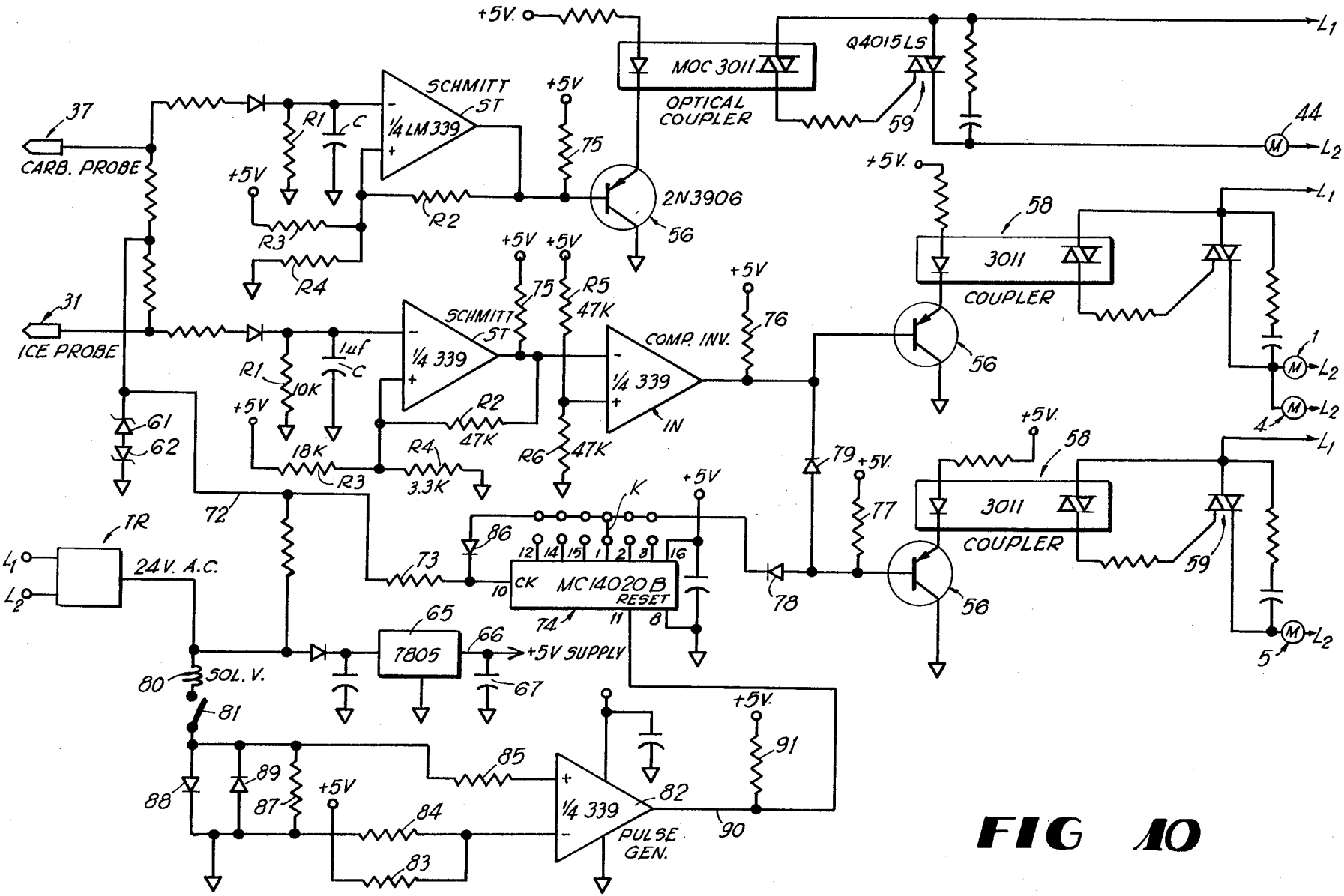
FIG. 10 illustrates another embodiment of the invention.
Figure 1:
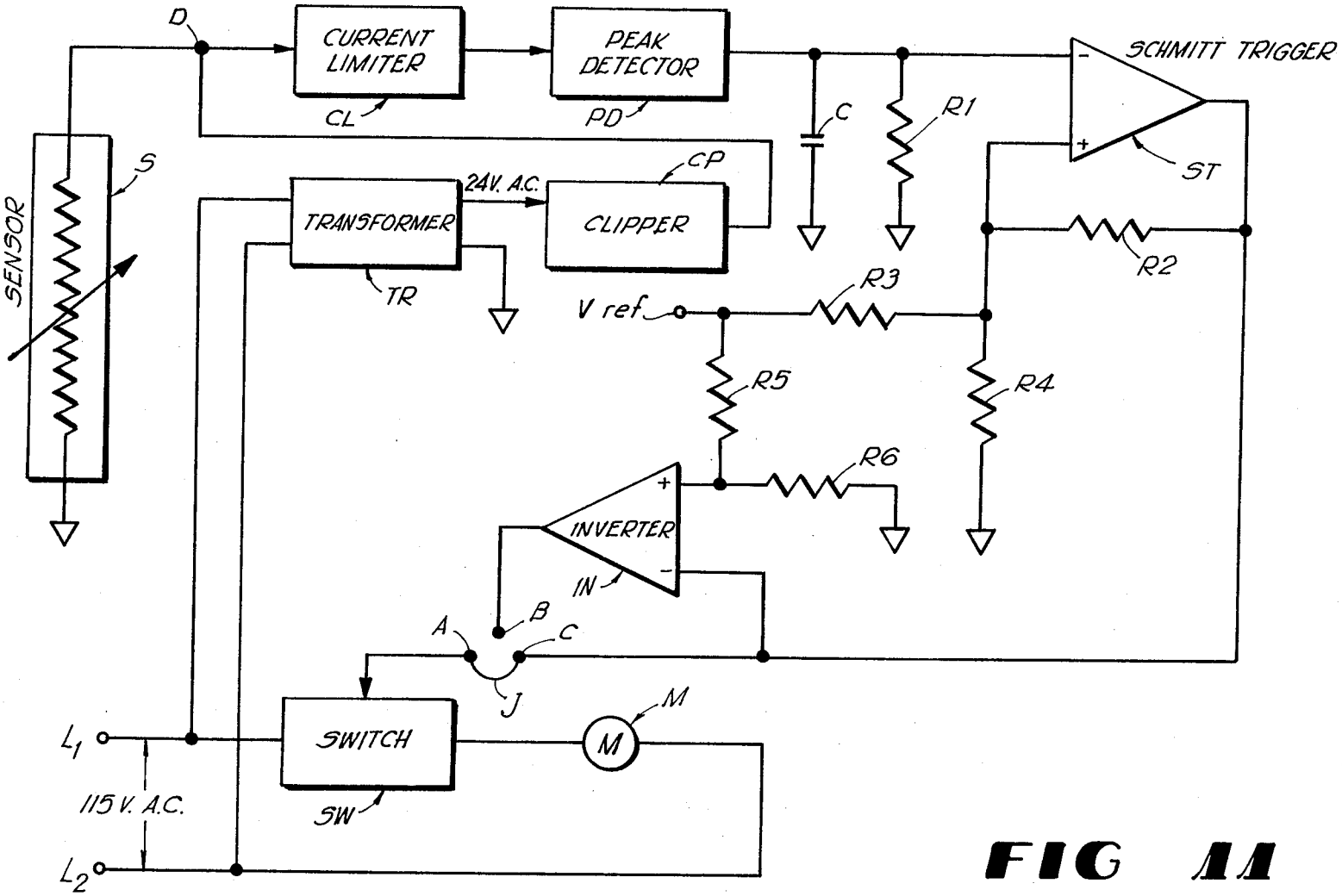

In FIG. 10, a control for the agitator motor 5 is additionally provided. The motor 5 drives the shaft 70 (FIG. 2) to which the blade or paddle 71 is fixed. This blade agitates or circulates the coolant water within the reservoir 11 as shown by the arrows in FIG. 2. It is desirable to operate the agitator whenever the compressor motor 1 is operating and also in conjunction with operation of the solenoids 14–18 which control the dispensing valves. In what follows, only that portion of the FIG. 10 circuit which has not prevously been described will be detailed.

The sixty cycle DC clipped and AC balanced 24 VAC supply is connected by the conductor 72 through the current limiting resistor 73 as the "clock" input to the 12-stage counter 74. The output at pin 1 of this counter (type MC14020B) controls the transistor stage 56 of the switch 56, 58, 59 controlling the agitator motor 5 and this transistor stage is also connected to the transistor stage 56 of the switch controlling the compressor motor 1. Each of the stages 56 is normally held off by the respective resistors 75, 76 and 77 connected to the +5 V dc supply. The two diodes 78 and 79 connected to the output of the counter 74 form an OR gate so that if the compressor motor 1 is energized or if a drink is being dispensed, the agitator motor 5 is also energized. In the latter case, the counter 74 also provides a thirty-four second time delay after terminating of drink dispensing before the agitator motor is deenergized.

To appreciate this function, it will be seen that the solenoid winding 80 at any dispensing nozzle, when energized by the associated lever 24–28 to close the appropriate switch 81, will apply the 24 VAC supply to the non-inverting input to the comparator section 82 through the current limiting resistor 85. The inverting input is connected between the +5 V supply and ground by the voltage dividing resistor chain 83,84. The current through the winding 80 is connected to ground through the resistor 87 and the diodes 88 and 89 limit the voltage drop across this resistor so that power loss on the sensor circuits is minimized. The comparator section 82 compares the 60 Hz signal across the resistor 87 to the 0.5 V reference at the junction of the resistors 83 and 84 so that the output of the section is a 60 Hz square wave when a solenoid 80 is energized. Since the output conductor 90 is connected to the "reset" pin of the counter 74, the counter 74 is reset when the solenoid switch 81 is closed and continues to be reset periodically at the same rate as the clock input until the switch 81 is opened. The initial "reset" pulse causes the output pin of the counter to go "low" so that the path from the +5 V supply through the resistor 77 and the diode 78 biasses the associated pnp stage 56 on. This "on" state will continue until the 60 Hz clock inputs cause the output pin of the counter 74 again to go "high" (thirty-four seconds). Thus, the agitator motor 5 will continue to run until the counter 74 counts out. Obviously, a different count ouptut pin of the counter 74 could be used to provide a different time delay simply by differently connecting the hard wiring at K.

When the output pin of the counter 74 goes "high", the clock input is inhibited by the diode 86 and the counter will remain in this state until a switch 81 is again closed.

The diodes 78 and 79 constitute an OR gate. If the compressor motor 1 is energized, the voltage drop across the resistor 77 through the diode 79 will turn the agitator motor 5 on.

Figure 12:
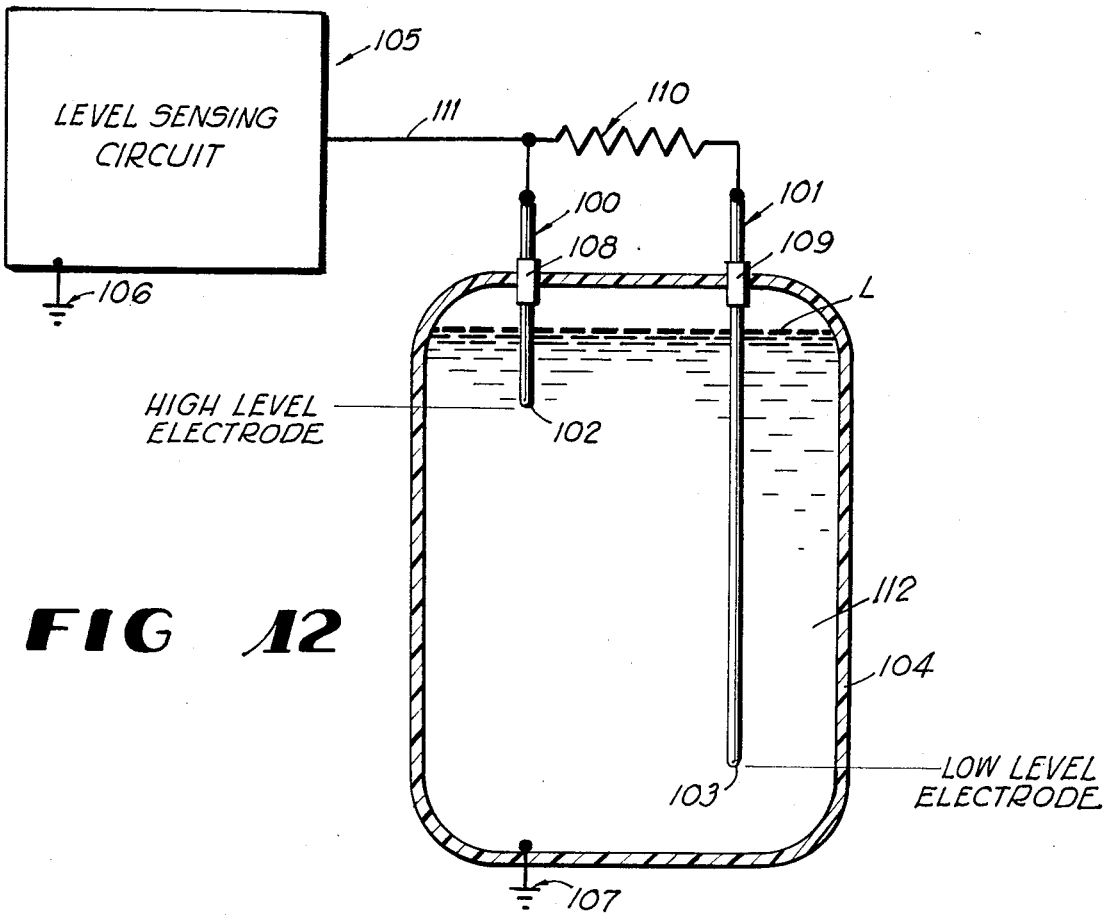
FIG. 12 is a view illustrating the manner in which the invention may be used with simple probes.

FIG. 12 illustrates the manner in which the Schmitt trigger means according to this invention may be used in association with simple electrodes or probes 100 and 101. Each of these probes comprises an electrically conductive rod, the tips 102 and 103 of which are disposed at different levels within the reservoir 104. The reservoir 104 is electrically conductive and provides the ground for the electronic system 105, as symbolically illustrated at 106 and 107. The reservoir contains a quantity of electically conductive liquid whose level L as illustrated is sufficient to contact the tips 102 and 103 of both probes. The probes pass through suitable insulating sleeves 108 and 109 and they are electrically connected by the resistor 110.

The conductor 111 provides the circuitry 105 with the sensor input. It should be recognized that the two simple probes 100 and 101 may be used in lieu of the special sensor of FIGS. 6–8 or the special sensor of FIGS. 3 and 4, the disposition as shown in FIG. 12 being equivalent to the use of the special sensor of FIGS. 6–8. That is, when the level of the conductive liquid 112 drops below the tip 102, the resistor 110 is no longer shunted and its value is "seen" by the circuit 105. This is equivalent to the level dropping just below the exposed conductor 38 in FIGS. 6–8.

When the level drops below the tip 103, the resistance value "seen" by the circuitry 105 is infinite. Obviously, two such simple probes and associated resistor may also be used to detect ice bank size. Also, it will be obvious that more than two probes 100 and 101 may be used, the successive pairs of which are bridged by separate resistors such as 110. In FIG. 12, such an arrangement can be employed to detect a plurality of liquid levels, one or more between the low and high levels illustrated, the tips of the added probes determining the respective levels. It should be noted, however, that additional Schmitt trigger devices would have to be employed in parallel in order to sense the various resistance threshold levels.

Figure 13:
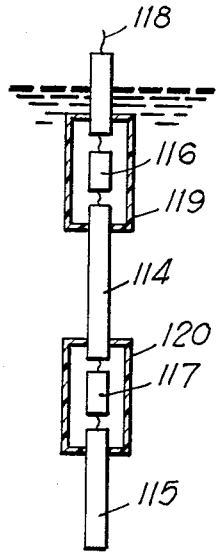
FIGS. 13–16 illustrate a modified form of probe according to this invention.
Figure 14:
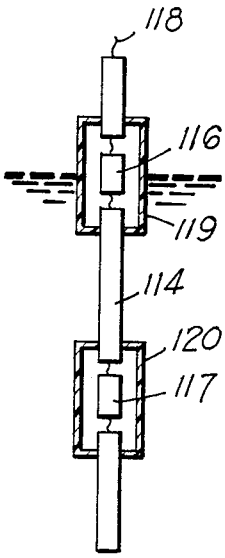
Figure 15:
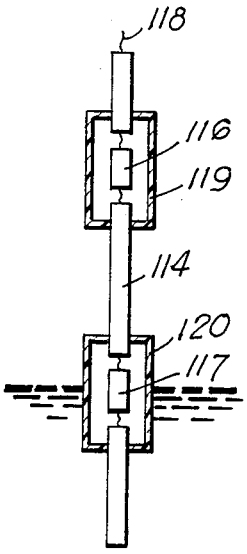
Figure 16:
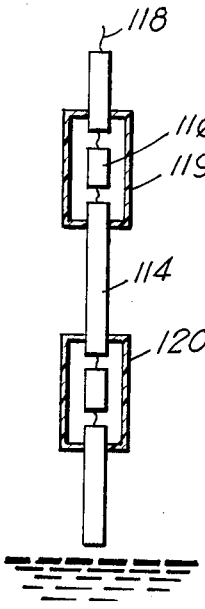

In FIGS. 13–16, a modified form of the FIG. 6 type of sensor is shown. Here, the sensor comprises a series of three axially aligned but spaced conductors 113, 114 and 115, the two conductors 113 and 114 being connected by the resistor 116 and the conductors 114 and 115 being connected by the resistor 117. FIG. 13 shows the condition in which both of the resistors 116 and 117 is shunted; FIG. 14 shows only the resistor 117 shunted; FIG. 15 shows the condition in which neither resistor is shunted but with the resistance value "seen" by the circuit connected to the wire 118 is finite; and FIG. 16 shows the condition in which the resistance "seen" is infinite. The impermeable insulating sheaths 119 and 120 are identical to their counterparts in FIGS. 6–8.

Obviously, all four level conditions of FIGS. 13–16 may be detected if three Schmitt trigter devices are connected in parallel to the wire 118, to respond to the three pairs of threshold levels of resistance "seen" at the wire 118.

What is claimed is:

1. An electronic control circuit comprising in combination:

a source of low voltage AC;

means for clipping said low voltage AC to provide a balanced AC signal;

a liquid-contacting sensor connected to said balanced AC signal for developing a voltage peak level of the balanced AC signal which varies in response to a sensed condition;

peak detector means connected to said sensor for developing a DC control signal whose magnitude varies with said voltage peak level;

Schmitt trigger means for producing an output in response to upper and lower threshold levels of said DC control signal; and a control switch actuated in response to the output of said Schmitt trigger means.

2. An electronic control circuit comprising in combination:

a source of low voltage AC;

means for clipping said low voltage AC to provide a balanced AC signal;

a liquid-contacting sensor connected to said balanced AC signal for developing a voltage peak level of the balanced AC signal which varies in response to a sensed condition;

peak detector means connected to said sensor for developing a DC control signal whose magnitude varies with said voltage peak level;

Schmitt trigger means for producing an output in response to upper and lower threshold levels of said DC control signal;

an inverter for inverting the output of said Schmitt trigger means; and a control switch actuated in response to the output of said inverter.

3. An electronic control circuit as defined in claim 2 wherein said sensor comprises an electrically conductive rod having an impervious, electrically insulating sheath surrounding said rod so that a tip thereof is exposed.

4. An electronic control circuit as defined in claim 1 wherein said sensor comprises a pair of axially aligned but spaced electrically conducting rods, a resistor electrically connecting said rods, and an electrically insulating sheath surrounding said resistor.

5. An electronic control circuit comprising in combination:

a source of low voltage AC;

means for clipping said low voltage AC to provide a balanced AC signal;

a liquid-contacting sensor connected to said balanced AC signal for developing a voltage peak level of the balanced AC signal which varies in response to a sensed condition;

peak detector means connected to said sensor for developing a DC control signal whose magnitude varies with said voltage peak level;

Schmitt trigger means for producing an output in response to upper and lower threshold levels of said DC control signal;

an inverter for inverting the output of said Schmitt trigger means;

a control switch; and jumper means for controlling said control switch from the output of said Schmitt trigger means or from the output of said inverter.

6. An electronic control circuit comprising in combination:

a source of low voltage AC;

means for clipping said low voltage AC to provide a balanced AC signal;

sensor means connected to said balanced AC signal for developing a voltage peak level of the balanced AC signal which varies in response to a sensed condition;

peak detector means connected to said sensor for developing a DC control signal whose magnitude varies with said voltage peak level;

Schmitt trigger means for producing an output in response to upper and lower threshold levels of said DC control signal; and a control switch actuated in response to the output of said Schmitt trigger means.

7. In a carbonated beverage dispensing machine having a cooling water reservoir; a refrigerant system including an evaporator disposed within said reservoir so as to cool a supply of coolant water therein, a condenser, and a compressor for circulating refrigerant through said evaporator and said condenser in a closed cycle so as to build up an ice mass around said evaporator; a carbonated water cooling coil disposed in said reservoir; a carbonated water reservoir connected to said carbonated water cooling coil; pump means for supplying water to said carbonated water reservoir; at least one dispensing nozzle connected to said carbonated water cooling coil; solenoid valve means for controlling the dispensing of a carbonated beverage from said nozzle; an improved ice sensing apparatus comprising in combination:

probe means for sensing the size of said ice mass, said probe means comprising an electrically conductive rod having a water impervious electrically insulated sheath surrounding said rod so that the tip thereof is exposed, said tip being disposed in said coolant water reservoir adjacent to said evaporator whereby said tip is alternately enclosed in said ice mass and exposed to said coolant water, as said ice mass grows and shrinks, respectively;

an electronic control means connected to said probe means comprising a source of balanced AC voltage connected to said probe means through a resistive network having an output point;

peak detecting means connected to said output point, said peak detecting means including a rectifier and a parallel resistance-capacitance circuit for providing a DC control signal whose magnitude is a function of the size of said ice mass as sensed by said probe means; and Schmitt trigger comparator means, connected to said parallel resistance capacitance circuit for providing a control output signal to said compressor in response to relative values of said DC control signal and a predetermined reference voltage, whereby operation of compressor, controls the size of said ice mass in response to conditions detected by said probe means.

8. An electronic control circuit for carbonated beverage dispensers, comprising in combination:

a source of low voltage AC for driving dispensing solenoid valves;

means for clipping said low voltage AC to provide a balanced AC signal;

a liquid-contacting sensor connected to said balanced AC signal for developing a voltage peak level of the balanced AC signal which varies in response to a sensed condition;

peak detector means connected to said sensor for developing a DC control signal whose magnitude varies with said voltage peak level;

Schmitt trigger means for producing an output in response to upper and lower threshold levels of said DC control signal;

an inverter for inverting the output of said Schmitt trigger means;

a control switch; and means for optionally controlling said control switch from the output of said Schmitt trigger means or from the output of said inverter.

9. An electronic control circuit as defined in claim 8 wherein said sensor is a liquid level sensor and said control switch is directly controlled by the output of said Schmitt trigger means.

10. An electronic control circuit as defined in claim 8 wherein said sensor is an ice bank size sensor and said control switch is directly controlled by the output of said inverter.

11. An electronic control circuit for carbonated beverage dispensing machines, comprising in combination:

a source of low voltage AC for driving dispensing solenoid valves;

means for clipping said low voltage AC to provide a balanced AC signal;

an ice mass size sensor connected to said balanced AC signal;

peak detector means connected to said sensor for producing a DC control signal whose magnitude varies directly with ice mass size;

Schmitt trigger means responsive to said DC control signal and an inverter for inverting the output of said Schmitt trigger means;

a refrigerant compresser control switch controlled by said inverter;

an agitator motor control switch;

an OR gate having the output of said inverter as one input and having an output connected to said agitator motor control switch;

pulse generator means responsive to dispensing solenoid valve energization for producing a train of output pulses; and a counter having a reset input, a clock input and a count output, said output pulses being connected to said reset input and said balanced AC being connected to said clock input, and means connected between said count output and said clock input to hold the count represented by said count output, said count output being connected as an input to said OR gate.

12. In an electronic control circuit as defined in claim 11 including a carbonated water level sensor connected to said balanced AC; second peak detector means for producing a second DC control signal whose magnitude varies inversely with sensed water level; second Schmitt trigger means responsive to said second DC control signal; and a water supply pump control switch actuated by the output of said second Schmitt trigger means.

13. An electronic control circuit comprising in combination:

a source of low voltage AC;

means for clipping said low voltage AC to provide a balanced AC signal;

sensor means connected to said balanced AC signal for providing a path to ground which varies in resistance value responsive to a sensed condition;

peak detector means connected to said sensor means for produced a DC control signal whose magnitude varies directly with said resistance value; and Schmitt trigger means responsive to said DC control signal for producing a control signal.

14. An electronic control circuit as defined in claim 13 including a reservoir for an electrically conductive medium, which reservoir provides said ground; said sensor means being responsive to the quantity of said medium contained in said reservoir to provide said variable resistance path to ground, through said medium.

* * * * *